United States Patent [19]

Wisecup

[11] Patent Number: 4,680,836

[45] Date of Patent: Jul. 21, 1987

[54] ONE-PIECE PLASTICS FASTENER

[75] Inventor: David R. Wisecup, Xenia, Ohio

[73] Assignee: Monarch Marking Systems, Inc., Dayton, Ohio

[21] Appl. No.: 812,539

[22] Filed: Dec. 23, 1985

[51] Int. Cl.[4] ..... B65D 33/34

[52] U.S. Cl. ..... 24/150 FP; 24/16 PB; 292/322

[58] Field of Search ..... 24/150 FP, 16 PB, 17 AP, 24/30.5 P, 297; 292/317, 321, 322

[56] References Cited

U.S. PATENT DOCUMENTS

| | | | |
|---|---|---|---|
| 3,466,077 | 9/1969 | Moberg | 24/150 FP |
| 3,712,655 | 1/1973 | Fuehrer | 292/322 |
| 3,881,759 | 5/1975 | Fuehrer | 292/321 |
| 3,973,299 | 8/1976 | Keefe | 24/150 FP |
| 4,059,300 | 11/1977 | Moberg et al. | 292/322 |
| 4,183,567 | 1/1980 | Bone | 292/318 |
| 4,248,462 | 2/1981 | Choi | 292/322 |

FOREIGN PATENT DOCUMENTS

| | | | |
|---|---|---|---|
| 2714918 | 10/1978 | Fed. Rep. of Germany | 292/322 |
| 3315073 | 11/1983 | Fed. Rep. of Germany | 24/16 PB |

*Primary Examiner*—Victor N. Sakran
*Attorney, Agent, or Firm*—Joseph J. Grass

[57] ABSTRACT

There is disclosed a one-piece molded fastener composed of plastics material, wherein there is a socket having a through-passage and a head connected by a filament. The head is insertable into the socket in one direction to be non-releaseably gripped by prongs or spring fingers on the inside of the socket. There is a provision on the head for preventing the head from being inserted into the passage through the other end of the socket to a position where it would be releasably gripped by the prongs.

5 Claims, 8 Drawing Figures

FIG-1
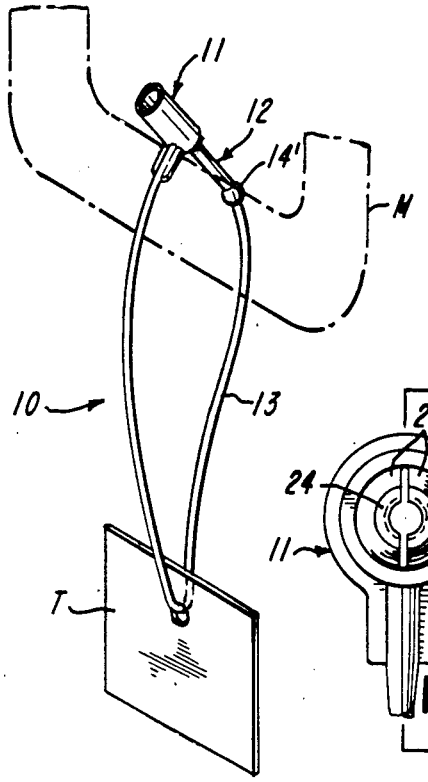
FIG-2
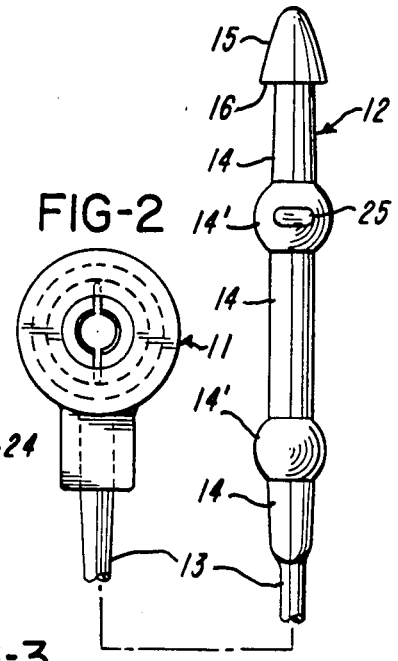
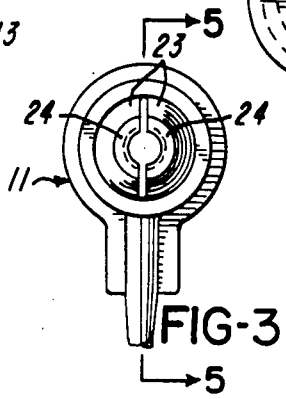
FIG-3
FIG-4
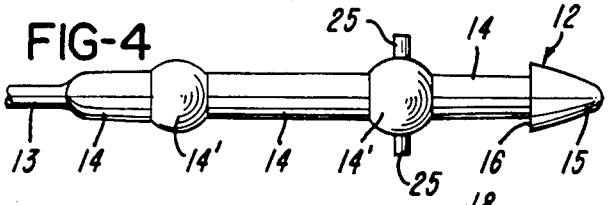
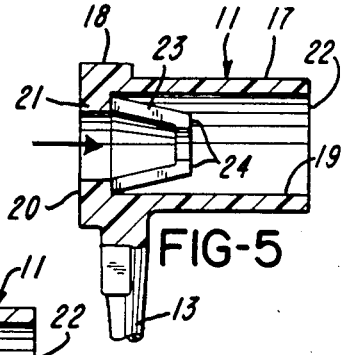
FIG-5
FIG-6
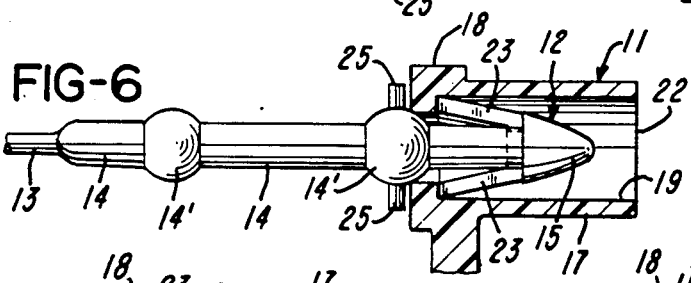
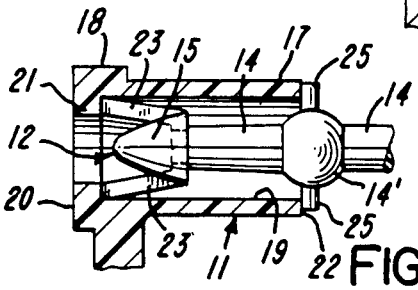
FIG-7
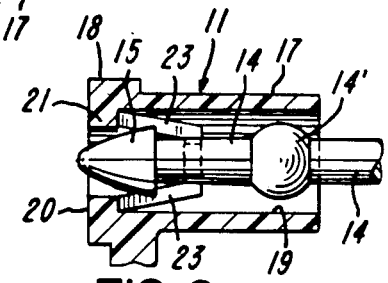
FIG-8 PRIOR ART

ONE-PIECE PLASTICS FASTENER

BACKGROUND OF THE INVENTION

1. Field of the Invention

This invention relates to the field of plastics fasteners.

2. Brief Description of the Prior Art

The following U.S. Pat. Nos. are made of record: 3,881,759 of Charles Fuehrer granted May 6, 1975; 3,973,299 of Jack D. Keefe granted Aug. 10, 1976; and 4,183,567 of Arnold R. Bone granted Jan. 15, 1980.

SUMMARY OF THE INVENTION

It is an object of the invention to provide an improved low-cost, easy-to-mold, and easy-to-use plastics fastener.

In accordance with a specific embodiment of the invention, there is provided a one-piece fastener composed of flexible, molded plastics material and having a socket and a head connected at its one end to the socket and at its other end to the head, with the socket having a passage therethrough and having opposite first and second ends. The head is insertable into the passage from either end of the socket. The socket has flexible resilient prongs or spring fingers disposed in the passage for non-releasably gripping the head when inserted through the first end of the socket and adapted to releasably grip the head in the event the head could be inserted through the second end to a sufficient depth. A projection or stop on the head limits the depth to which the head can be inserted into the passage through the second end to prevent the head from being releasably engaged with the prongs. In that the stop prevents the releasable engagement, the user is not misled into believing that the prongs are non-releasably gripping the head.

DESCRIPTION OF THE DRAWINGS

FIG. 1 is a perspective view showing how a fastener according to the invention holds a tag onto merchandise;

FIG. 2 is a partly broken away elevational view of the fastener with its head and socket out of engagement;

FIG. 3 is an elevational view of the socket from the side opposite the side shown in FIG. 2;

FIG. 4 is an elevational view of the head aligned with the socket of FIG. 5;

FIG. 5 is a sectional view of the socket taken generally along line 5—5 of FIG. 3;

FIG. 6 is a partly sectional view showing the head non-releasably engaged with the socket;

FIG. 7 is a partly sectional view showing how the invention prevents releasable engagement of the head with the socket; and FIG. 8 is a partly sectional view illustrating the prior art problem.

DESCRIPTION OF THE PREFERRED EMBODIMENT

Referring initially to FIG. 1, there is shown a fastener generally indicated at 10 used to attach a tag T to merchandise M. When engaged as shown in FIG. 1, the fastener 10 forms a loop, thus the fastener 10 is considered to be a loop-type fastener.

Referring now also to FIGS. 2 through 7, the fastener 10 includes a socket 11, a head 12 and a flexible filament 13 connecting the socket 11 and the head 12. In the illustrated embodiment, the filament 13 is stretched to its desired length (as is conventional in making various filaments such as fishing line and nylon thread). The head 12 can also be considered to include a thicker unstretched portion 14 having enlargements 14' thereon. The enlargements 14' assist in inserting the head 12 into the socket 11. The head 12 has a generally conical head portion 15 terminating at a continuous annular shoulder 16. The socket 11 has a tubular portion 17 with an outwardly extending annular flange 18 to which one end of the filament 13 is connected. The socket 11 has a passage 19 extending therethrough. The passage 19 is shown to be slightly smaller at end 20, because of internal flange 21, than at opposite end 22. Flexible resilient fingers or prongs 23 converge inwardly and are spreadable to receive the head portion 15. When the head portion 15 has been inserted into the passage 19 through the end 20 to a depth as shown in FIG. 6, ends 24 of the prongs 23 move resiliently radially inwardly to the position shown in FIG. 6, wherein ends 24 of the prongs 23 are against the shoulder 16. The prongs 23 thus non-releasably grip the head portion 15 of the head 12 and prevent its withdrawal. Therefore, the tag T is securely attached to the merchandise M.

FIG. 7 illustrates that in the event the user attempts to insert the head 12 into the passage 19 through end 22, a stop or a pair of radially outwardly extending projections 25 on the head 12 abuts the end 22 and prevents the.head 12 from being inserted through end 22 to a position in which the prongs 23 can hold or grip the head portion 15. As shown, the transverse extent of the projections 25 is greater than the diameter of the passage 19. But for the stop 25, the head portion 15 could be inserted through the end 22 into the passage 19 to a depth as shown for example in FIG. 8. In FIG. 8 the stop 25 is omitted. In the FIG. 8 position, the user is mislead to believing that the head is non-releasably coupled to the socket 11, unless, of course, the user would test the coupling by trying to pull the head 12 out of the socket 11. The invention obviates any such misleading of the user.

Other embodiments and modifications of the invention will suggest themselves to those skilled in the art, and all such of these as come within the spirit of this invention are included within its scope as best defined by the appended claims.

I claim:

1. A one-piece fastener composed of flexible, molded, plastics material, the fastener comprising a socket, a head and a flexible filament connected at its one end to the socket and at its other end to the head, the socket having a passage therethrough, the socket having opposite first and second ends, the head being insertable into the passage from either end of the socket, the socket having flexible resilient prongs disposed in the passage for non-releasably gripping the head when inserted through the first end and adapted to releasably grip the head in the event the head could be inserted through the second end to a sufficient depth, and means on the head and contactable with the socket for limiting the depth to which the head can be inserted through the second end of the socket to prevent the head from being releasably engaged with the prongs.

2. A one-piece fastener as defined in claim 1, wherein the prongs converge, the head includes a shoulder, and wherein the limiting means prevents the head from being releasably held by the prongs.

3. A one-piece fastener as defined in claim 1, wherein the limiting means is effective when brought into abutment with the second end of the socket.

4. A one-piece fastener as defined in claim 1, wherein the limiting means includes a projection adapted to abut the second end of the socket.

5. A one-piece fastener as defined in claim 1, wherein the limiting means includes a pair of radially outwardly extending projections on the head having a greater extent than the passage and adapted to abut the second end of the socket.

* * * * *

REEXAMINATION CERTIFICATE (1257th)

United States Patent [19] [11] B1 4,680,836

Wisecup [45] Certificate Issued Apr. 17, 1990

[54] ONE-PIECE PLASTICS FASTENER

[75] Inventor: David R. Wisecup, Xenia, Ohio

[73] Assignee: Monarch Marking Systems, Inc., Dayton, Ohio

Reexamination Request:
No. 90/001,363, Oct. 30, 1987

Reexamination Certificate for:

| | |
|---|---|
| Patent No.: | **4,680,836** |
| Issued: | **Jul. 21, 1987** |
| Appl. No.: | **812,539** |
| Filed: | **Dec. 23, 1985** |

[51] Int. Cl.[4] ..... B65D 33/34

[52] U.S. Cl. ..... 24/704.2; 24/16 PB; 292/322

[58] Field of Search ..... 24/704.2, 16 PB, 17 AP, 24/30.5 P, 297; 292/317, 321, 322

[56] References Cited

U.S. PATENT DOCUMENTS 3,402,435 9/1968 Merser ..... 24/16

FOREIGN PATENT DOCUMENTS 2714918 10/1978 Fed. Rep. of Germany ..... 292/322

*Primary Examiner*—Victor N. Sakran

[57] ABSTRACT

There is disclosed a one-piece molded fastener composed of plastics material, wherein there is a socket having a through-passage and a head connected by a filament. The head is insertable into the socket in one direction to be non-releasably gripped by prongs or spring fingers on the inside of the socket. There is a provision on the head for preventing the head from being inserted into the passage through the other end of the socket to a position where it would be releasably gripped by the prongs.

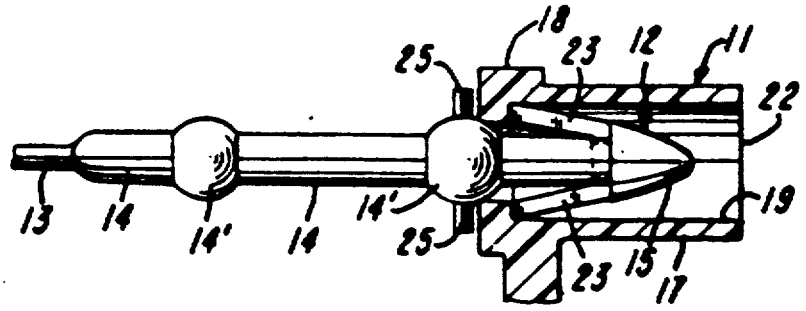

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claims 1 and 2 are determined to be patentable as amended.

Claims 3, 4 and 5, dependent on an amended claim, are determined to be patentable.

New claims 6–10 are added and determined to be patentable.

1. A one-piece fastener composed of flexible, molded, plastics material, the fastener comprising a socket, a head and a flexible filament connected at its one end to the socket and at its other end to the head, the socket having a passage therethrough, the socket having opposite first and second ends, the head being insertable into the passage from either end of the socket, the socket having flexible resilient prongs disposed in the passage for non-releasably gripping the head when inserted through the first end and adapted to releasably grip the head in the event the head could be inserted through the second end to a sufficient depth, and means on the head and contactable with the socket for limiting the depth to which the head can be inserted through the second end of the socket to prevent the head from being *held* releasably engaged with the prongs.

2. A one-piece fastener [as defined in claim 1,] *composed of flexible, molded, plastics material, the fastener comprising a socket, a head and a flexible filament connected at its one end to the socket and at its other end to the head, the socket having a passage therethrough, the socket having opposite first and second ends, the head being insertable into the passage from either end of the socket, the socket having flexible resilient prongs disposed in the passage for non-releasably gripping the head when inserted through the first end and adapted to releasably grip the head in the event the head could be inserted through the second end to a sufficient depth, and means on the head and contactable with the socket for limiting the depth to which the head can be inserted through the second end of the socket to prevent the head from being releasably engaged with the prongs,* wherein the prongs converge, the head includes a shoulder, and wherein the limiting means prevents the head from being releasably held by the prongs.

*6. A one-piece fastener composed of flexible, molded, plastics material, the fastener comprising a socket, a head and a flexible filament connected at its one end to the socket and at its other end to the head, the socket including a tubular portion having a passage therethrough, the tubular portion of the socket having opposite first and second ends, the head being insertable into the passage from either end of the socket, the socket having flexible resilient prongs terminating at ends disposed in the passage between the first and second ends for non-releasably gripping the head when inserted through the first end and adapted to releasably grip the head in the event the head could be inserted through the second end to a sufficient depth, and means on the head and contactable with the second end of the tubular portion of the socket for limiting the depth to which the head can be inserted through the second end of the socket to prevent the head from being held releasably engaged with the prongs.*

*7. A one-piece fastener composed of flexible, molded, plastics material, the fastener comprising a socket, a head and a flexible filament connected at its one end to the socket and at its other end to the head, wherein the head includes a shoulder, the socket including a tubular portion having a passage therethrough, the tubular portion of the socket having opposite first and second ends, the head being insertable into the passage from either end of the socket, the socket having flexible resilient converging prongs terminating at ends disposed in the passage between the first and second ends for non-releasably gripping the shoulder on the head when inserted through the first end and adapted to releasably grip the head in the event the head could be inserted through the second end to a sufficient depth, means on the head and contactable with the second end of the tubular portion of the socket for limiting the depth to which the head can be inserted through the second end of the socket to prevent the head from being releasably engaged with the prongs, and wherein the limiting means prevents the head from being releasably held by the prongs.*

*8. A one-piece fastener composed of flexible, molded, plastics material, the fastener comprising a socket, a head and a flexible filament connected at its one end to the socket and at its other end to the head, the socket including a tubular portion having a passage therethrough, the tubular portion of the socket having opposite first and second ends, the head being insertable into the passage from either end of the socket, the socket having flexible resilient prongs terminating at ends disposed in the passage between the first and second ends for non-releasably gripping the head when inserted through the first end and adapted to releasably grip the head in the event the head could be inserted through the second end to a sufficient depth, means on the head and contactable with the second end of the socket for limiting the depth to which the head can be inserted through the second end of the tubular portion of the socket to prevent the head from being held releasably engaged with the prongs, and wherein the limiting means is effective when brought into abutment with the second end of the socket.*

*9. A one-piece fastener composed of flexible, molded, plastics material, the fastener comprising a socket, a head and a flexible filament connected at its one end to the socket and at its other end to the head, the socket including a tubular portion having a passage therethrough, the tubular portion of the socket having opposite first and second ends, the head being insertable into the passage from either end of the socket, the socket having flexible resilient prongs terminating at ends disposed in the passage between the first and second ends for non-releasably gripping the head when inserted through the first end and adapted to releasably grip the head in the event the head could be inserted through the second end to a sufficient depth, means on the head and contactable with the second end of the tubular portion of the socket for limiting the depth to which the head can be inserted through the second end of the socket to prevent the head from being held releasably engaged with the prongs, and wherein the limiting means includes a*

*projection adapted to abut the second end of the tubular portion.*

*10. A one-piece fastener composed of flexible, molded, plastics material, the fastener comprising a socket, a head and a flexible filament connected at its one end to the socket and at its other end to the head, the socket including a tubular portion having a passage therethrough, the tubular portion of the socket having opposite first and second ends, the head being insertable into the passage from either end of the socket, the socket having flexible resilient prongs terminating at ends disposed in the passage between the first and second ends for non-releasably gripping the head when inserted through the first end and adapted to releasably grip the head in the event the head could be inserted through the second end to a sufficient depth, means on the head and contactable with the second end of the tubular portion of the socket for limiting the depth to which the head can be inserted through the second end of the socket to prevent the head from being held releasably engaged with the prongs, and wherein the limiting means includes a pair of radially outwardly extending projections on the head having a greater extent than the passage and adapted to abut the second end of the socket.*

* * * * *